US008872712B2

(12) United States Patent
Lee

(10) Patent No.: US 8,872,712 B2
(45) Date of Patent: Oct. 28, 2014

(54) MULTI-BAND ANTENNA

(75) Inventor: Cheng-Jung Lee, Santa Clara, CA (US)

(73) Assignee: Amazon Technologies, Inc., Reno, NV (US)

( * ) Notice: Subject to any disclaimer, the term of this patent is extended or adjusted under 35 U.S.C. 154(b) by 396 days.

(21) Appl. No.: 13/211,138

(22) Filed: Aug. 16, 2011

(65) Prior Publication Data

US 2012/0313830 A1 Dec. 13, 2012

Related U.S. Application Data

(60) Provisional application No. 61/494,799, filed on Jun. 8, 2011.

(51) Int. Cl.
*H01Q 1/00* (2006.01)

(52) U.S. Cl.
USPC ..... 343/729

(58) Field of Classification Search
USPC ..... 343/729, 846, 848, 850, 852, 700 MS, 343/702
See application file for complete search history.

(56) References Cited

U.S. PATENT DOCUMENTS

| | | | | |
|---|---|---|---|---|
| 6,861,986 | B2 * | 3/2005 | Fang et al. | 343/700 MS |
| 7,148,849 | B2 * | 12/2006 | Lin | 343/700 MS |
| 7,218,282 | B2 * | 5/2007 | Humpfer et al. | 343/700 MS |
| 7,400,302 | B2 * | 7/2008 | Winter | 343/702 |
| 7,495,620 | B2 * | 2/2009 | Wang et al. | 343/702 |
| 8,077,116 | B2 | 12/2011 | Shamblin et al. | |
| 8,134,517 | B2 * | 3/2012 | Wang et al. | 343/846 |
| 8,558,742 | B2 * | 10/2013 | Chou et al. | 343/700 MS |
| 8,564,021 | B2 * | 10/2013 | Sato | 257/194 |
| 2004/0108957 | A1 | 6/2004 | Umehara et al. | |
| 2007/0008222 | A1 * | 1/2007 | Wang et al. | 343/700 MS |
| 2008/0012777 | A1 | 1/2008 | Lin et al. | |
| 2009/0015497 | A1 * | 1/2009 | Nagumo et al. | 343/750 |
| 2010/0060542 | A1 * | 3/2010 | Zheng et al. | 343/843 |
| 2011/0234470 | A1 * | 9/2011 | Chen | 343/895 |

FOREIGN PATENT DOCUMENTS

| | | | |
|---|---|---|---|
| WO | 2009026304 | A1 | 2/2009 |
| WO | 2010090573 | A1 | 12/2010 |
| WO | 2012170579 | A1 | 12/2012 |

OTHER PUBLICATIONS

International Search Report and Written Opinion for International Application No. PCT/US2012/041162 mailed Sep. 5, 2012.
EPO Office Action for European Patent Application No. 12727069.2 mailed Jan. 24, 2014.

* cited by examiner

*Primary Examiner* — Huedung Mancuso
(74) *Attorney, Agent, or Firm* — Lowenstein Sandler LLP

(57) ABSTRACT

Methods and systems for extending a bandwidth of a multi-band antenna of a user device are described. A multi-band antenna includes a single radio frequency (RF) input coupled to a first antenna, the first antenna configured to provide a first resonant mode. The multi-band antenna also includes a second antenna parasitically coupled to the first antenna to provide additional resonant modes of the multi-band antenna.

28 Claims, 8 Drawing Sheets

MULTI-BAND ANTENNA

RELATED APPLICATIONS

This application claims to the benefit of U.S. Provisional Application No. 61/494,799, filed Jun. 8, 2011, which is hereby incorporated by reference in its entirety.

BACKGROUND OF THE INVENTION

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increased the antenna size or used active tuning elements to extend the bandwidth. Alternatively, conventional solutions used separate antennas to achieve different frequency bands. These solutions are not conducive to use in user devices, often because of the size of the available space for antennas on the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION OF THE PRESENT INVENTION

Methods and systems for extending a bandwidth of a multi-band antenna of a user device are described. In one embodiment, a multi-band antenna includes a single radio frequency (RF) input coupled to a first antenna, the first antenna configured to provide a first resonant mode. The multi-band antenna also includes a second antenna parasitically coupled to the first antenna to provide additional resonant modes of the multi-band antenna. The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein increase the bandwidth of the multi-band antenna by adding additional resonant modes, extending the frequency coverage. In one embodiment, the multi-band antenna extends the frequency coverage down to 700 MHz for use in 4G/LTE applications. In one embodiment, a multi-band antenna couples a monopole antenna and a T-monopole antenna to add resonant modes. The multi-band antenna has a single RF input that drives the monopole antenna and the T-monopole antenna is a parasitic element. By coupling the monopole and T-monopole antennas, two resonant modes can be created in the lower band and two resonant modes can be created in the higher band. The proposed multi-band antenna uses two resonant modes to cover 700 MHz-960 MHz to cover the 3G band, as well as the LTE band in a single RF input. The embodiments described herein are not limited to use in 3G and LTE bands, but could be used to increase the bandwidth of a multi-band frequency in other bands, such as Dual-band Wi-Fi, GPS and Bluetooth frequency bands. The embodiments described herein provide a multi-band antenna with a single RF input feed and does not use any active tuning to achieve the extended bandwidths. The embodiments described herein also provide a multi-band antenna with increased bandwidth in a size that is conducive to being used in a user device.

Figure 1:
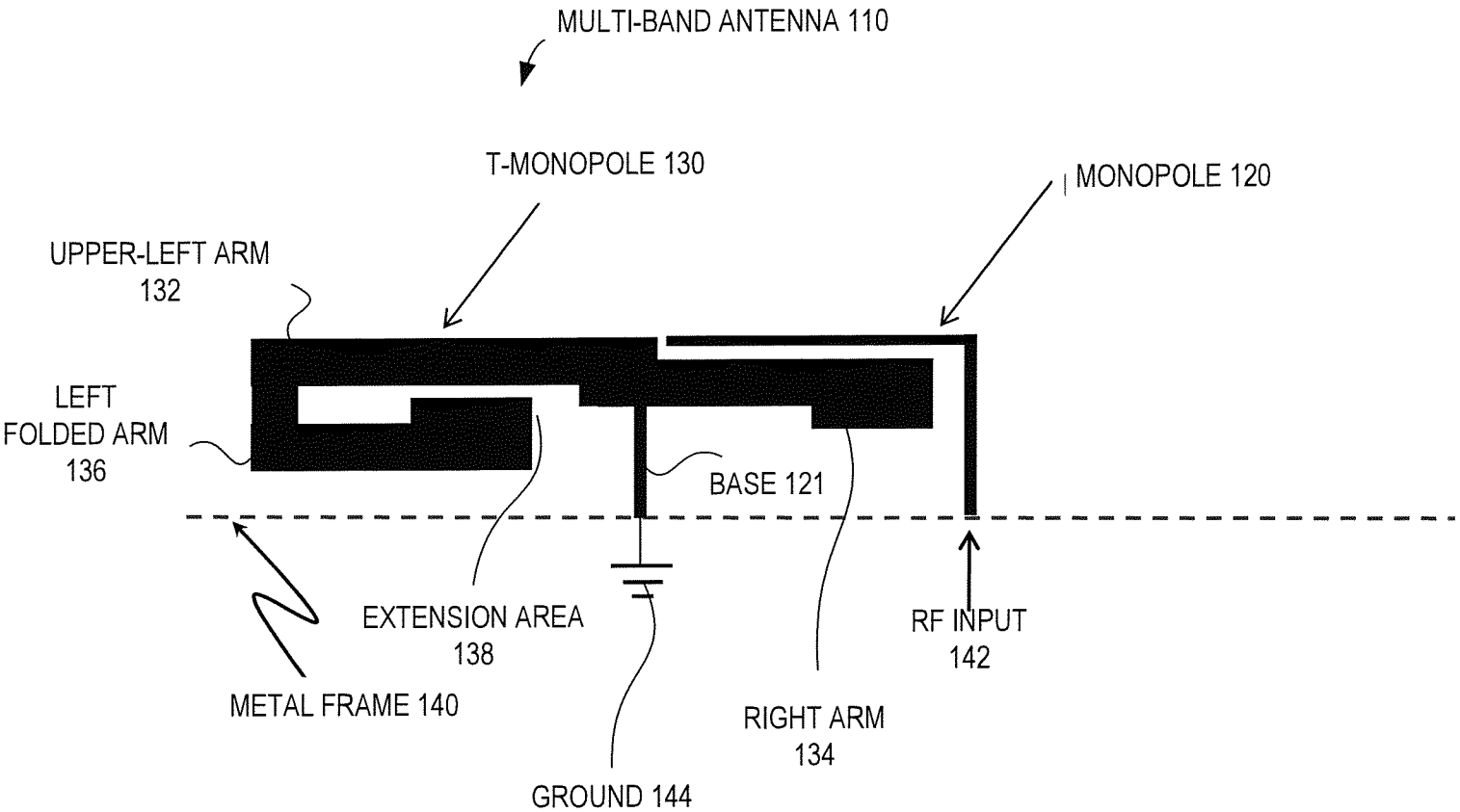
FIG. 1 illustrates one embodiment of a multi-band antenna including a T-monopole antenna and a monopole antenna.

FIG. 1 illustrates one embodiment of a multi-band antenna 110 including a T-monopole antenna 130 and a monopole antenna 120. In this embodiment, the multi-band antenna 110 is fed at the single RF input 142 at the monopole antenna 120, and the T-monopole antenna 130 is a parasitic element. A parasitic element is an element of the multi-band antenna that is not driven directly by the single RF input. Rather, the single RF input directly drives another element of the multi-band antenna, which parasitically induces a current on the parasitic element. In particular, by directly inducing current on the other element by the single RF input, the directly-fed element radiates electromagnetic energy, which causes another current on the parasitic element to also radiate electromagnetic energy, in multiple resonant modes. In the depicted embodiment, the T-monopole antenna 130 is parasitic because it is physically separated from the monopole antenna 120 that is driven at the single RF input 142. The driven monopole antenna 120 parasitically excites the current flow of the T-monopole antenna 130. In one embodiment, the T-monopole antenna 130 and monopole antenna 120 can be physically separated by a gap. Alternatively, other antenna configurations may be used to include a driven element and a parasitic element. The dimensions of the monopole and T-monopole antennas 120 and 130 may be varied to achieve the desired frequency range as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

Figure 3:
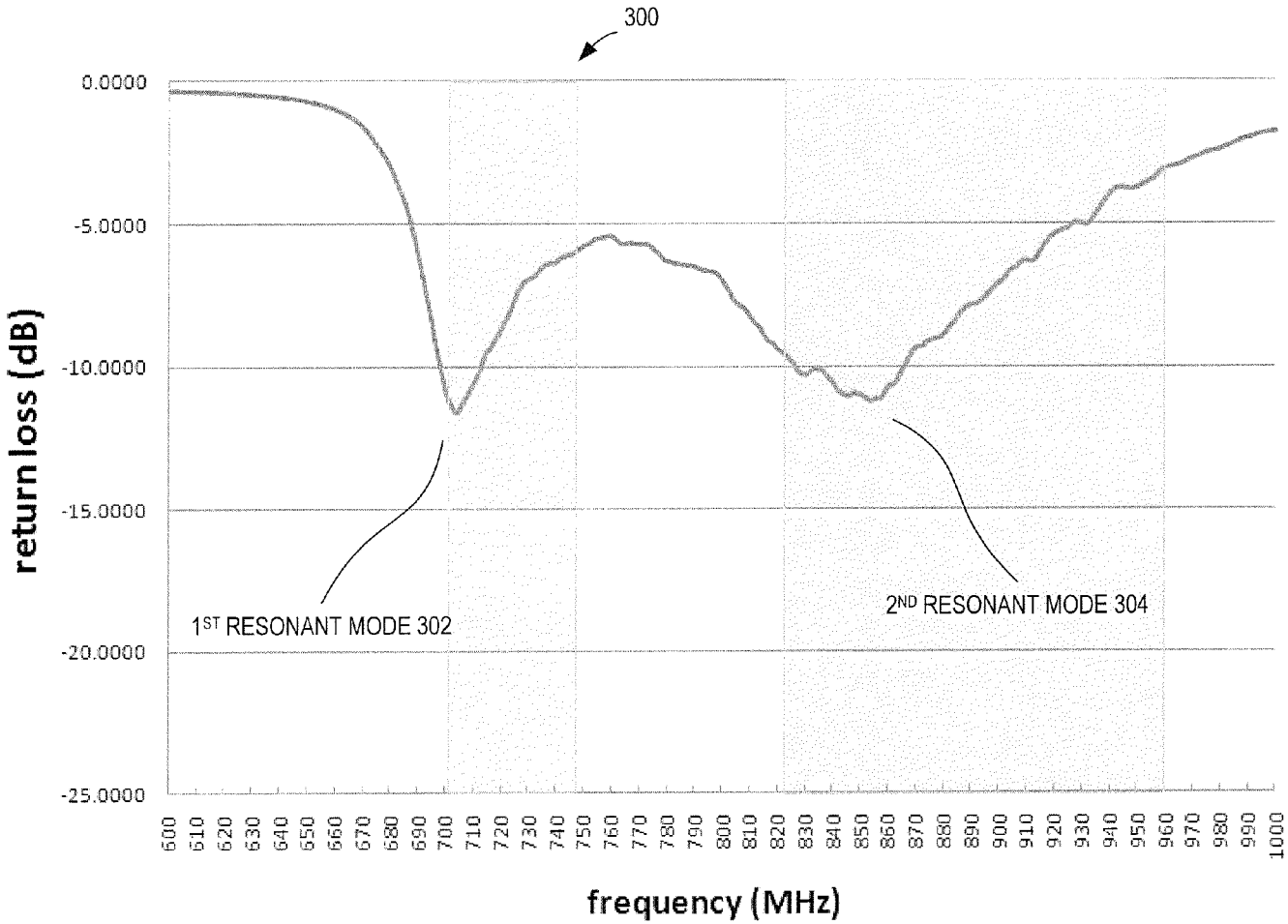
FIG. 3 is a graph of a frequency response of the multi-band antenna of FIG. 1 according to one embodiment.
Figure 4:
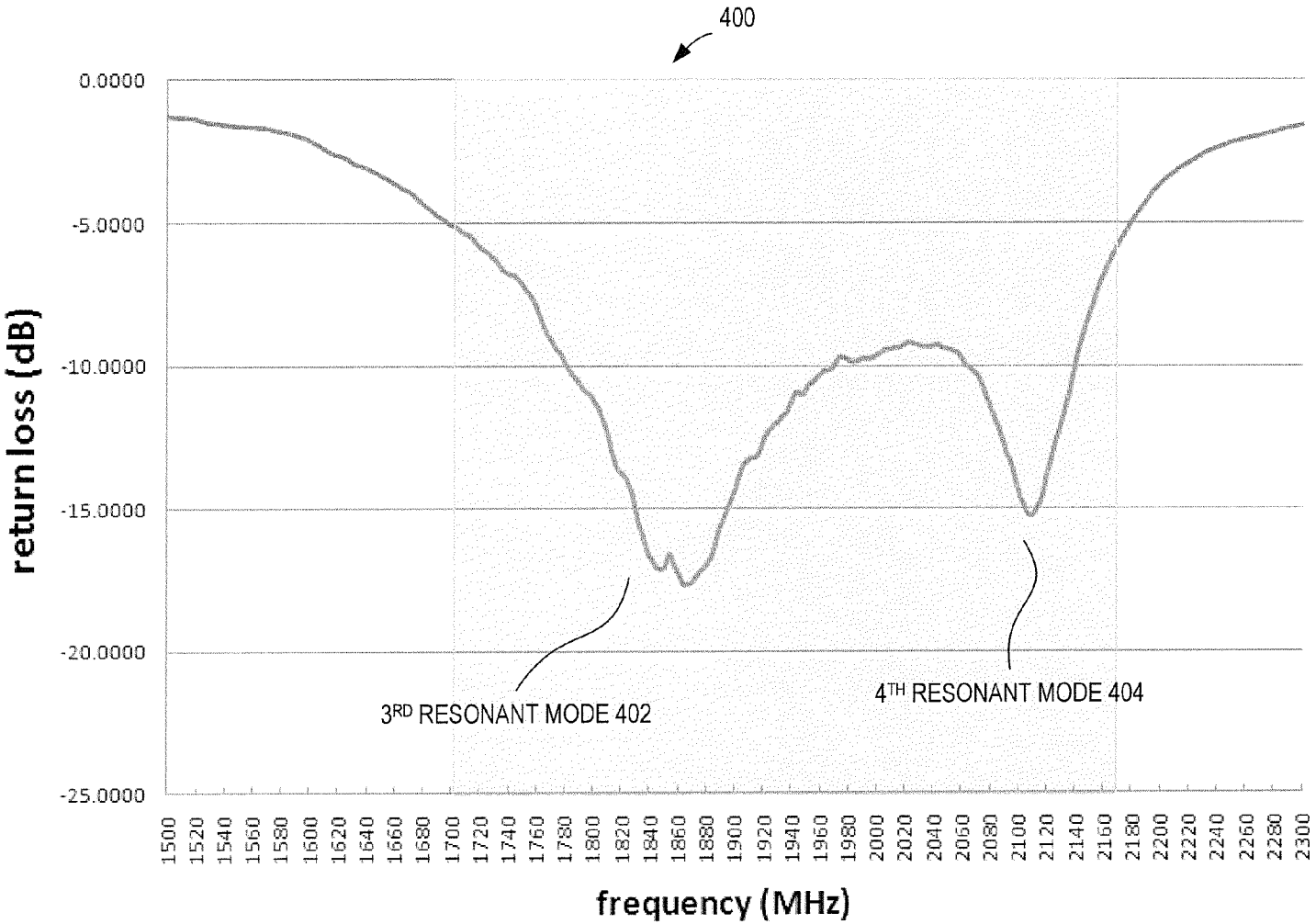
FIG. 4 is a graph of a frequency response of the multi-band antenna of FIG. 1 according to one embodiment.

In this embodiment, there are four resonate modes created. The T-monopole antenna 130 includes a base 121 coupled to a ground 144. The ground 144 may be a metal frame of the user device. The ground 144 may be a system ground or one of multiple grounds of the user device. The upper-left arm 132, which extends out from a first side of the base 121, creates the first resonate mode at 700 MHz in the low band. The right arm 134, which extends out from a second side of the base 121, creates the second resonate mode at 850 MHz in the low band. The left folded arm 136, which extends back towards the first side of the base 121 from a distal end of the upper-left arm 132, creates the third resonate mode at 1860 MHz in the high band. The monopole 120 creates the fourth resonate mode at 2110 MHz in the high band. It should be noted that in this embodiment, the monopole 120, which is driven by the single RF input 142 creates one resonant mode, however, in other embodiments, the driven element may create more than one resonant mode as would be appreciated by one of ordinary skill in the art having the benefit of this disclosure. The multi-band antenna 110 increases the bandwidth by adding extra resonant modes, and extends the frequency coverage to 700 MHz. FIGS. 3 and 4 are graphs 300 and 400 of a frequency response of the multi-band antenna 110 of FIG. 1 according to one embodiment. FIG. 3 illustrates the first resonant mode 302 and second resonant mode 304, and FIG. 4 illustrates the third resonant mode 402 and fourth resonant mode 404 of the multi-band antenna 110. It should be understood that the terms right, left, and upper with respect to the arms have been used for ease of description of the figures, however, the upper-left arm, upper-right arm, left arm, right arm, etc, are relative to the particular view within the Figure. Of course, when viewing the antenna from other perspectives these relative terms would differ.

In one embodiment, the left folded arm 136 of the T-monopole antenna 130 has an extension area 138. The extension area 138 not only contributes to the frequency for the third resonant mode, but also controls the impedance matching of the fourth resonate mode. Alternatively, other configurations of the multi-band antenna 110 may be used as would be appreciated by one of ordinary skill in the art having the benefit of this disclosure. It should also be noted that the antennas described herein may be implemented with two-dimensional geometries, as well as three-dimensional geometries as would be appreciated by one of ordinary skill in the art having the benefit of this disclosure.

The RF input 142 may be a feed line connector that couples the multi-band antenna 110 to a feed line (also referred to as the transmission line), which is a physical connection that carriers the RF signal to and/or from the multi-band antenna 110. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is physically coupled to monopole antenna 120 of the multi-band antenna 110, but is not physically coupled to the T-monopole antenna 130 of the multi-band antenna 110. However, the T-monopole antenna 130 is parasitically coupled to the monopole antenna 120.

In one embodiment, the multi-band antenna 110 is disposed on a dielectric carrier of the user device. The dielectric carrier may be any non-conductive material of the user device upon which the conductive material of the multi-band antenna 110 can be disposed without making electrical contact with other metal of the user device. In another embodiment, the multi-band antenna 110 is disposed on or within a circuit board, such as a printed circuit board (PCB).

Figure 2:
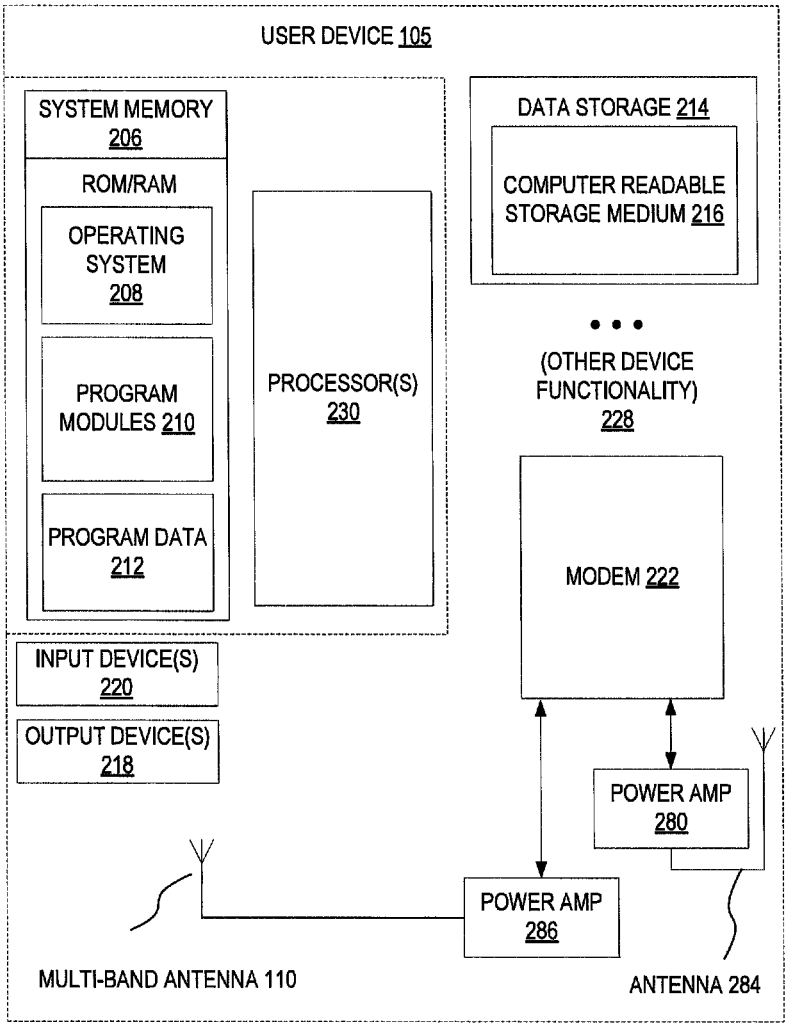
FIG. 2 is a block diagram of a user device having the multi-band antenna of FIG. 1 according to one embodiment.

FIG. 2 is a block diagram of a user device 105 having the multi-band antenna 110 of FIG. 1 according to one embodiment. The user device 105 includes one or more processors 230, such as one or more CPUs, microcontrollers, field programmable gate arrays, or other types of processing devices. The user device 105 also includes system memory 206, which may correspond to any combination of volatile and/or non-volatile storage mechanisms. The system memory 206 stores information which provides an operating system component 208, various program modules 210, program data 212, and/or other components. The user device 105 performs functions by using the processor(s) 230 to execute instructions provided by the system memory 206.

The user device 105 also includes a data storage device 214 that may be composed of one or more types of removable storage and/or one or more types of non-removable storage. The data storage device 214 includes a computer-readable storage medium 216 on which is stored one or more sets of instructions embodying any one or more of the functions of the user device 105, as described herein. As shown, instructions may reside, completely or at least partially, within the computer readable storage medium 216, system memory 206 and/or within the processor(s) 230 during execution thereof by the user device 105, the system memory 206 and the processor(s) 230 also constituting computer-readable media. The user device 105 may also include one or more input devices 220 (keyboard, mouse device, specialized selection keys, etc.) and one or more output devices 218 (displays, printers, audio output mechanisms, etc.).

The user device 105 further includes a wireless modem 222 to allow the user device 105 to communicate via a wireless network (e.g., such as provided by a wireless communication system) with other computing devices, such as remote computers, an item providing system, and so forth. The wireless modem 222 allows the user device 105 to handle both voice and non-voice communications (such as communications for text messages, multimedia messages, media downloads, web browsing, etc.) with a wireless communication system. The wireless modem 222 may provide network connectivity using any type of digital mobile network technology including, for example, cellular digital packet data (CDPD), general packet radio service (GPRS), enhanced data rates for GSM evolution (EDGE), universal mobile telecommunications system (UMTS), 1 times radio transmission technology (1xRTT), evaluation data optimized (EVDO), high-speed downlink packet access (HSDPA), WiFi, etc. In other embodiments, the wireless modem 222 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 105 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 105 to communicate with other devices, such as other user devices, server computing systems, telephone devices, or the like. In addition to wirelessly connecting to a wireless communication system, the user device 105 may also wirelessly connect with other user devices. For example, user device 105 may form a wireless ad hoc (peer-to-peer) network with another user device.

The wireless modem 222 may generate signals and send these signals to power amplifier (amp) 280 or power amp 286 for amplification, after which they are wirelessly transmitted via the multi-band antenna 110 or antenna 284, respectively. The antenna 284, which is an optional antenna that is separate from the multi-band antenna 110, may be any directional, omnidirectional, or non-directional antenna in a different frequency band than the frequency bands of the multi-band antenna 110. The antenna 284 may also transmit information using different wireless communication protocols than the multi-band antenna 110. In addition to sending data, the multi-band antenna 110 and the antenna 284 also receive data, which is sent to wireless modem 222 and transferred to processor(s) 230. It should be noted that, in other embodiments, the user device 105 may include more or less components as illustrated in the block diagram of FIG. 2.

In one embodiment, the user device 105 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the multi-band antenna 110 that operates at a first frequency band and the second wireless connection is associated with a second resonant mode of the multi-band antenna 110 that operates at a second frequency band. In another embodiment, the first wireless connection is associated with the multi-band antenna 110 and the second wireless connection is associated with the antenna 284. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 222 is shown to control transmission to both antennas 110 and 284, the user device 105 may alternatively include multiple wireless modems, each of which is configured to transmit/receive data via a different antenna and/or wireless transmission protocol. In addition, the user device 105, while illustrated with two antennas 110 and 284, may include more or fewer antennas in various embodiments.

The user device 105 delivers and/or receives items, upgrades, and/or other information via the network. For example, the user device 105 may download or receive items from an item providing system. The item providing system receives various requests, instructions, and other data from the user device 105 via the network. The item providing system may include one or more machines (e.g., one or more server computer systems, routers, gateways, etc.) that have processing and storage capabilities to provide the above functionality. Communication between the item providing system and the user device 105 may be enabled via any communication infrastructure. One example of such an infrastructure includes a combination of a wide area network (WAN) and wireless infrastructure, which allows a user to use the user device 105 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 105.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 105 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 105 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

As described above, other types of antennas can be used other than the T-monopole antenna 130 depicted in FIG. 1.

Figure 5:
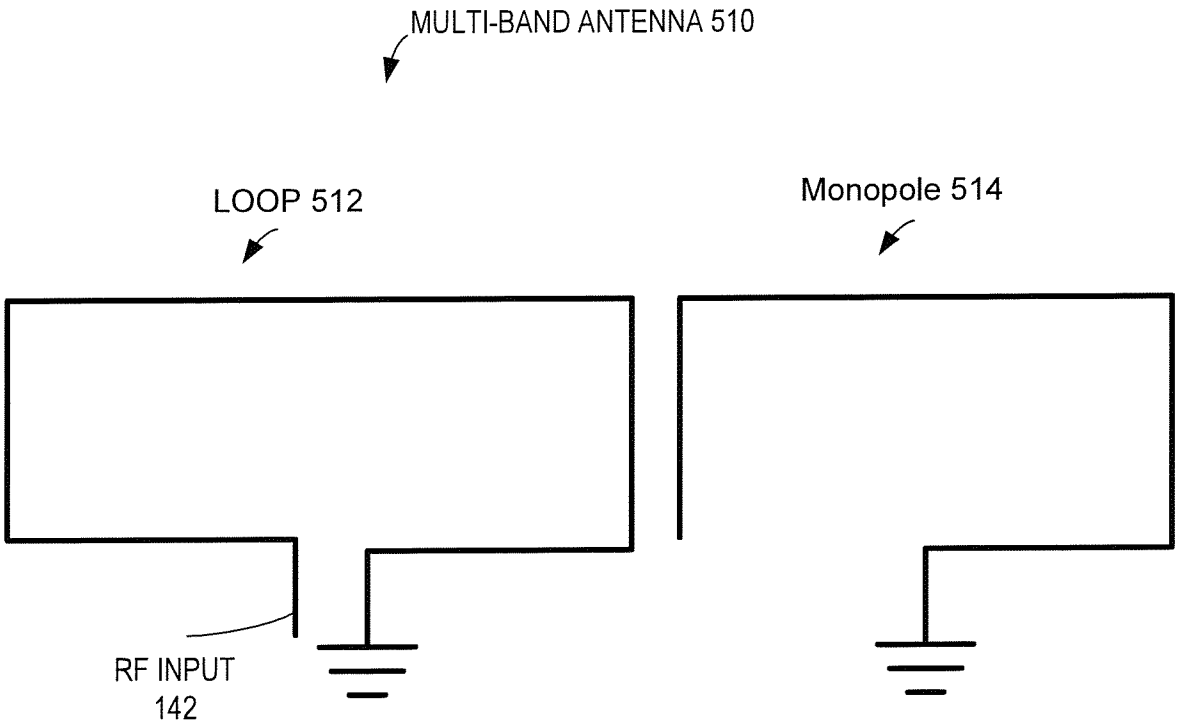
FIG. 5 illustrates another embodiment of a multi-band antenna including a loop antenna and a monopole antenna.
Figure 6:
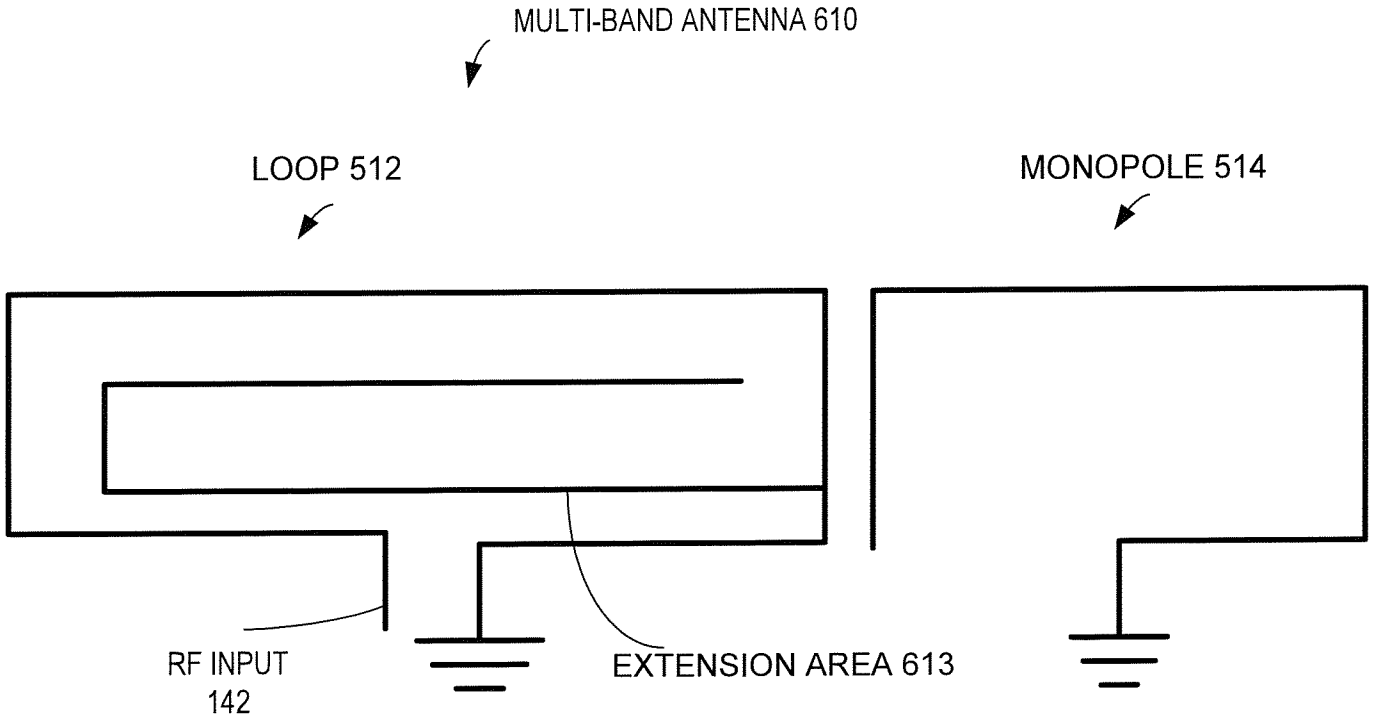
FIG. 6 illustrates another embodiment of a multi-band antenna including a loop antenna with an extension area and a monopole antenna.

FIG. 5 illustrates another embodiment of a multi-band antenna 510 including a loop antenna 512 and a monopole antenna 514. The loop antenna 512 is driven and the monopole antenna 514 is a parasitic element. The loop antenna 512 can be designed to include multiple resonant modes, while the monopole 514 is used to extend the bandwidth of the antenna by adding an additional resonant mode. FIG. 6 illustrates another embodiment of a multi-band antenna 610 including the loop antenna 512 with an extension area 613 and the monopole antenna 514. The multi-band antenna 610 of FIG. 6 is like the multi-band antenna 510 of FIG. 5, but includes an extension area 613 on the loop antenna 512. In the depicted embodiment, the extension area 613 extends towards the inside of the loop 512, and forms a C-shape within the loop 512. In other embodiments, the extension area 613 may be designed to have other shapes and the dimensions may vary to adjust the frequency response. In this embodiment, the extension area 613 adds another resonant mode to the multi-band antenna 610. There are two resonant modes without the extension area 613 and three resonant modes with the extension area 613. The extension area 613 may also be used for impedance matching the multi-band antenna and the single RF input. Alternatively, other configurations may be used to add additional resonant modes and to control impedance matching between the multi-band antenna and the single RF input as would be appreciated by one of ordinary skill in the art having the benefit of this disclosure.

In one embodiment, the multi-band antenna includes at least three resonant modes. In another embodiment, the multi-band antenna includes four resonant modes. Alternatively, the multi-band antenna may include more than four resonant modes as would be appreciated by one of ordinary skill in the art having the benefit of this disclosure.

Figure 7:
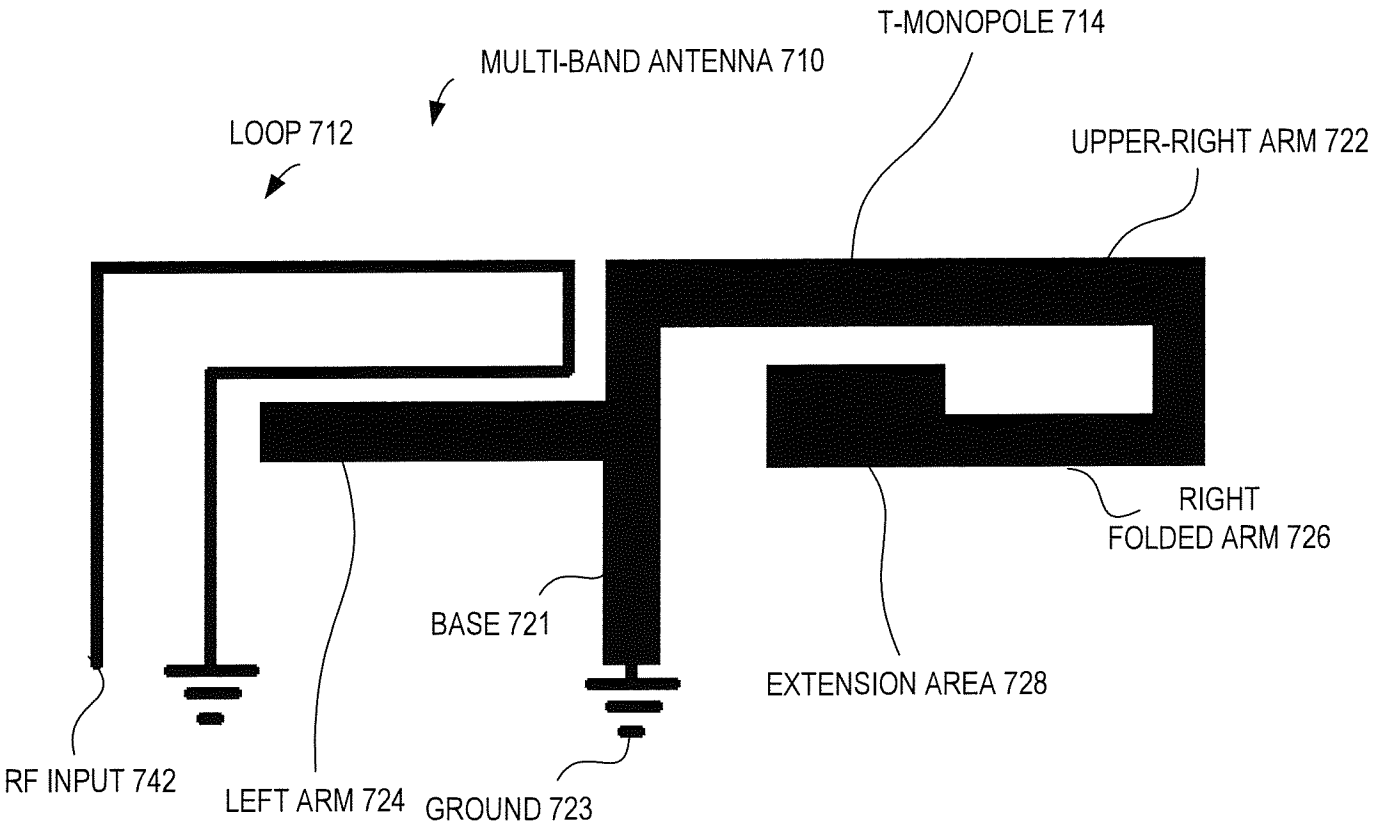
FIG. 7 illustrates another embodiment of a multi-band antenna including a loop antenna and a T-monopole antenna.

In other embodiments, other types of antennas may be used for other than monopoles, such as illustrated in FIG. 7. FIG. 7 illustrates another embodiment of a multi-band antenna 710 including a loop antenna 712 and a T-monopole antenna 714. The loop antenna 712 of FIG. 7 can be used to add an additional resonant mode. In this embodiment, the multi-band antenna 710 is fed at the single RF input 742 at the loop antenna 712, and the T-monopole antenna 714 is a parasitic element. In the depicted embodiment, the T-monopole antenna 714 is parasitic because it is physically separated from the loop antenna 712 that is driven at the single RF input 742. The driven loop antenna 712 parasitically excites the current flow of the T-monopole antenna 714. The T-monopole antenna 714 and loop antenna 712 can be separated by a gap. The dimensions of the loop and T-monopole antennas 712 and 714 may be varied to achieve the desired frequency range as would be appreciated by one of ordinary skill in the art having the benefit of this disclosure, as described herein.

In the depicted embodiment, the T-monopole antenna 714 includes a base 721 coupled to a ground 723. The ground 723 may be a metal frame of the user device. The ground 723 may be a system ground or one of multiple grounds of the user device. The T-monopole antenna 714 includes a left arm 724 that extends out from a first side of the base 721, and an upper-right arm 722 that extends out from a second side of the base 721. The T-monopole antenna 714 also includes a right folded arm 726 that extends back towards the second side of the base 721 from a distal end of the upper-right arm 722. In another embodiment, the T-monopole antenna 714 also includes an extension area 728 that extends a portion of the right folded arm 726 in another direction from a longitudinal axis of the right folded arm 726. In the depicted embodiment, the extension area 728 extends a portion of the right folded arm 726 towards the upper-right arm 722. This causes a smaller gap between the extended portion and the upper-right arm 722 than a gap between the non-extended portion and the upper-right arm 722. The portion of the right folded arm 726 may be at a distal end of the right folded arm 726 that is closes to the base 721. Alternatively, the extension area 726 may extend the right folded arm 726 in other directions as would be appreciated by one of ordinary skill in the art having the benefit of this disclosure.

In this embodiment, there are four resonate modes created. The upper-right arm 722 of the T-monopole antenna 714 creates the first resonate mode at 700 MHz in the low band. The left arm 724 of the T-monopole antenna 714 creates the second resonate mode at 850 MHz in the low band. The right folded arm 726 of the T-monopole antenna 714 creates the third resonate mode at 1860 MHz in the high band. The loop antenna 712 creates the fourth resonate mode at 2110 MHz in the high band. The multi-band antenna 710 increases the bandwidth by adding extra resonant modes, and extends the frequency coverage to 700 MHz. In other embodiments, the first resonant mode is in a range between 550 MHz and 850 MHz, the second resonant mode is in a range between 700 MHz and 1000 MHz, the third resonant mode is in a range between 1660 MHz and 2060 MHz, and the fourth resonant mode is in a range between 1910 MHz and 2310 MHz. In this embodiment, the order of frequencies of the first through fourth resonant modes is the opposite as the order of first, second, third, and fourth resonant modes from highest frequency to lowest frequency. Although in other embodiments, the first, second, third, and fourth notations can be assigned to different ones of the resonant modes. For example, in one embodiment, the resonant modes can be assigned from highest frequency to lowest frequency in a different order, such as the first resonant mode, the fourth resonant mode, the second resonant mode, and the third resonant mode. It should also be noted that the first, second, third and fourth notations on the resonant modes are not be strictly interpreted to being assigned to a particular frequency, frequency range, or elements of the multi-band antenna. Rather, the first, second, third, and fourth notations are used for ease of description.

In one embodiment, the right folded arm 726 of the T-monopole antenna 714 has an extension area 728. The extension area 728 not only contributes to the frequency for the third resonant mode, but also controls the impedance matching of the fourth resonate mode (i.e., impedance matching between the multi-band antenna and the single RF input. Alternatively, other configurations of the multi-band antenna 710 may be used as would be appreciated by one of ordinary skill in the art having the benefit of this disclosure. In other embodiments, the multi-band antenna 710 may be inverted such that the T-monopole antenna comprising an upper left arm, a left folded arm, and a right arm as would be appreciated by one of ordinary skill in the art having the benefit of this disclosure.

The RF input 742 may be a feed line connector that couples the multi-band antenna 710 to a feed line, like described above with respect to FIG. 1. In the depicted embodiment, the feed line connector is physically coupled to loop antenna 712 of the multi-band antenna 710, but is not physically coupled to the T-monopole antenna 714 of the multi-band antenna 710. However, the T-monopole antenna 714 is parasitically coupled to the loop antenna 712.

Figure 8:
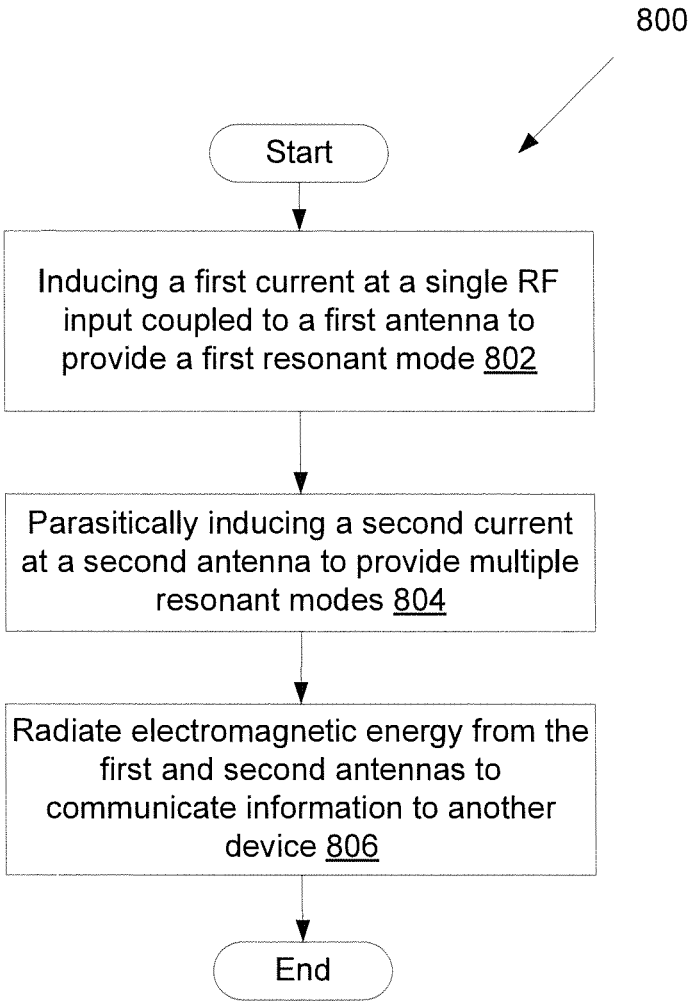
FIG. 8 is a flow diagram of an embodiment of a method of operating a user device having a multi-band antenna having a first antenna and a second antenna parasitically coupled to the first antenna according to one embodiment.

FIG. 8 is a flow diagram of an embodiment of a method 800 of operating a user device having a multi-band antenna having a first antenna and a second antenna parasitically coupled to the first antenna according to one embodiment. In method 800, a first current is induced at a single radio frequency (RF) input coupled to a first antenna to provide a first resonant mode (block 802). In response, the first antenna parasitically induces a second current at a second antenna that is parasitically coupled to the first antenna, the second antenna to provide multiple resonant modes (block 804). In response to the induced currents, electromagnetic energy is radiated from the first and second antennas to communicate information to another device (block 806). The electromagnetic energy forms a radiation pattern. The radiation pattern may be various shapes as would be appreciated by one of ordinary skill in the art having the benefit of this disclosure.

In one embodiment, a current is induced at the RF input, which induces a surface current flow of the first antenna. The first antenna parasitically induces a current flow of the second antenna. By inducing current flow at the second antenna, the second antenna increases the bandwidth of the multi-band antenna, providing additional two or more resonant modes to the resonant mode of the first antenna. As described herein, the second antenna is physically separated from the first antenna by a gap.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A multi-band antenna comprising:

a single radio frequency (RF) input;

a first antenna directly coupled to the single RF input, wherein the first antenna is configured to provide a first resonant mode of the multi-band antenna; and a second antenna parasitically coupled to the first antenna, wherein the second antenna is configured to provide a plurality of resonant modes of the multi-band antenna, wherein the second antenna is a T-monopole antenna comprising:

a base coupled to ground;

a first arm extending out from a first side of the base;

a second arm extending out from a second side of the base; and a folded arm extending back towards the second side of the base from a distal end of the second arm.

2. The multi-band antenna of claim 1, wherein the first antenna is a monopole antenna.

3. The multi-band antenna of claim 1, wherein the first antenna is a loop antenna.

4. The multi-band antenna of claim 1, wherein the first arm is configured to provide a second resonant mode as one of the plurality of resonant modes, the second arm is configured to provide a third resonant mode as one of the plurality of resonant modes, and the folded arm is configured to provide a fourth resonant mode as one of the plurality of resonant modes.

5. The multi-band antenna of claim 4, wherein the first resonant mode is in a range between 1910 MHz and 2310 MHz, the second resonant mode is in a range between 700 MHz and 1000 MHz, the third resonant mode is in a range between 550 MHz and 850 MHz, and the fourth resonant mode is in a range between 1660 MHz and 2060 MHz.

6. The multi-band antenna of claim 4, wherein an order of frequencies of the first, second, third, and fourth resonant modes from highest frequency to lowest frequency is the first resonant mode, the fourth resonant mode, the second resonant mode, and the third resonant mode.

7. The multi-band antenna of claim 1, wherein the T-monopole antenna further comprises an extension area that extends a portion of the second arm in another direction from a longitudinal axis of the second arm.

8. The multi-band antenna of claim 7, wherein the first arm is configured to provide a second resonant mode as one of the plurality of resonant modes, the second arm is configured to provide a third resonant mode as one of the plurality of resonant modes, and the folded arm and the extension area are configured to provide a fourth resonant mode as one of the plurality of resonant modes.

9. The multi-band antenna of claim 8, wherein the first resonant mode is in a range between 1910 MHz and 2310 MHz, the second resonant mode is in a range between 700 MHz and 1000 MHz, the third resonant mode is in a range between 550 MHz and 850 MHz, and the fourth resonant mode is in a range between 1660 MHz and 2060 MHz.

10. The multi-band antenna of claim 8, wherein an order of frequencies of the first, second, third, and fourth resonant modes from highest frequency to lowest frequency is the first resonant mode, the fourth resonant mode, the second resonant mode, and the third resonant mode.

11. The multi-band antenna of claim 8, wherein the extension area is configured to control impedance matching between the multi-band antenna and the single RF input.

12. The multi-band antenna of claim 1, wherein the first antenna is a loop antenna and the second antenna is a monopole antenna.

13. The multi-band antenna of claim 12, wherein the loop antenna comprises an extension area.

14. A user device comprising:

a wireless modem; and a multi-band antenna configured to radiate electromagnetic energy to communicate data to and from the wireless modem via a single radio frequency (RF) input coupled to the wireless modem, wherein the multi-band antenna comprising:

a first antenna directly coupled to the single RF input, wherein the first antenna is configured to provide a first resonant mode of the multi-band antenna; and a second antenna parasitically coupled to the first antenna, wherein the second antenna is configured to provide a plurality of resonant modes of the multi-band antenna, wherein the second antenna is a T-monopole antenna comprising:

a base coupled to ground;

a first arm extending out from a first side of the base;

a second arm extending out from a second side of the base; and a folded arm extending back towards the second side of the base from a distal end of the second arm.

15. The user device of claim 14, further comprising a power amplifier coupled to the wireless modem and the single RF input.

16. The user device of claim 14, wherein the first antenna is a monopole antenna.

17. The user device of claim 14, wherein the first antenna is a loop antenna.

18. The user device of claim 14, wherein the first arm is configured to provide a second resonant mode as one of the plurality of resonant modes, the second arm is configured to provide a third resonant mode as one of the plurality of resonant modes, and the folded arm is configured to provide a fourth resonant mode as one of the plurality of resonant modes.

19. The user device of claim 18, wherein the first resonant mode is in a range between 1910 MHz and 2310 MHz, the second resonant mode is in a range between 700 MHz and 1000 MHz, the third resonant mode is in a range between 550 MHz and 850 MHz, and the fourth resonant mode is in a range between 1660 MHz and 2060 MHz.

20. The user device of claim 18, wherein an order of frequencies of the first, second, third, and fourth resonant modes from highest frequency to lowest frequency is the first resonant mode, the fourth resonant mode, the second resonant mode, and the third resonant mode.

21. The user device of claim 14, wherein the T-monopole antenna further comprises an extension area that extends a portion of the second arm in another direction from a longitudinal axis of the second arm.

22. The user device of claim 21, wherein the first arm is configured to provide a second resonant mode as one of the plurality of resonant modes, the second arm is configured to provide a third resonant mode as one of the plurality of resonant modes, and the folded arm and the extension area are configured to provide a fourth resonant mode as one of the plurality of resonant modes.

23. The user device of claim 22, wherein the extension area is configured to control impedance matching between the multi-band antenna and the single RF input.

24. The use device of claim 14, wherein the multi-band antenna is disposed on a dielectric carrier.

25. A method of operating a user device, the method comprising:

inducing a first current at a single radio frequency (RF) input directly coupled to a first antenna of a multi-band antenna to provide a first resonant mode;

in response, parasitically inducing a second current at a second antenna of the multi-band antenna that is parasitically coupled to the first antenna, the second antenna to provide a plurality of resonant modes, wherein the second antenna is a T-monopole antenna comprising:

a base coupled to ground;

a first arm extending out from a first side of the base;

a second arm extending out from a second side of the base; and a folded arm extending back towards the second side of the base from a distal end of the second arm; and radiating electromagnetic energy from the first and second antennas of the multi-band antenna to communicate information to another device in response to the first and second currents.

26. The method of claim 25, wherein the first antenna is a monopole antenna.

27. The method of claim 25, wherein the first antenna is a loop antenna.

28. The method of claim 25, wherein the plurality of resonant modes comprises first, second, third, and fourth resonant modes, and wherein the first resonant mode is in a range between 550 MHz and 850 MHz, the second resonant mode is in a range between 700 MHz and 1000 MHz, the third resonant mode is in a range between 1660 MHz and 2060 MHz, and the fourth resonant mode is in a range between 1910 MHz and 2310 MHz.

* * * * *